US006413080B1

(12) United States Patent
Fogliani et al.

(10) Patent No.: US 6,413,080 B1
(45) Date of Patent: Jul. 2, 2002

(54) TUBULAR BURNER

(75) Inventors: Giuseppe Fogliani, Formigine; Giorgio Buccilli, Monza, both of (IT)

(73) Assignee: Worgas Bruciatori SRL, Formigine (IT)

( * ) Notice: Subject to any disclaimer, the term of this patent is extended or adjusted under 35 U.S.C. 154(b) by 0 days.

(21) Appl. No.: 09/582,691

(22) PCT Filed: Jan. 2, 1999

(86) PCT No.: PCT/EP99/00001

§ 371 (c)(1),
(2), (4) Date: Sep. 12, 2000

(87) PCT Pub. No.: WO99/35439

PCT Pub. Date: Jul. 15, 1999

(30) Foreign Application Priority Data

Jan. 2, 1998 (IT) ..... MO98A0001

(51) Int. Cl.[7] ..... F23D 14/10
(52) U.S. Cl. ..... 431/354; 239/553; 239/567
(58) Field of Search ..... 431/354; 239/432, 239/553, 566, 567, 568, 590

(56) References Cited

U.S. PATENT DOCUMENTS 1,443,907 A * 1/1923 Witzberger ..... 239/553

FOREIGN PATENT DOCUMENTS

DE 1626001 * 9/1969 ..... 239/568
DE 29710270 * 8/1997
GB 2266585 * 11/1993

* cited by examiner

*Primary Examiner*—Sara Clarke
(74) *Attorney, Agent, or Firm*—Reising, Ethington, Barnes, Kisselle, Learman & McCulloch, P.C.

(57) ABSTRACT

A tubular burner has a body comprising a diffuser portion provided with openings for discharging a mixture of air and fuel fed to the body through a Venturi tube arranged inside the body. The body has a cross section shaped in such a way that a distance between an outer wall of the Venturi tube and an inner wall of the body, when measured in a radial direction of the Venturi tube, has a first value substantially constant over a first portion of a perimeter of the Venturi tube and a second value greater than the first value over a second portion of the perimeter. A chamber is defined in the second portion between the outer wall of the Venturi tube and the inner wall of the body. The mixture passes through the chamber before being discharged through the openings. The chamber is delimited at a bottom thereof by laminar flow generating means for generating a substantially laminar flow of the mixture.

13 Claims, 2 Drawing Sheets

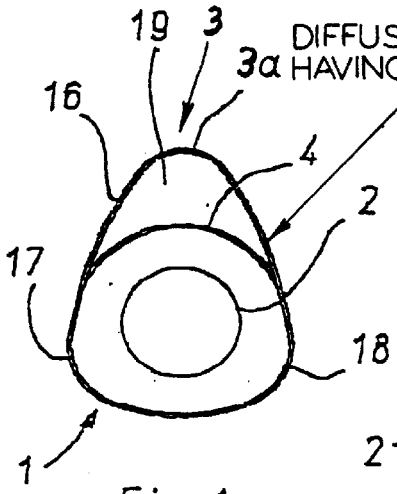
Fig.1
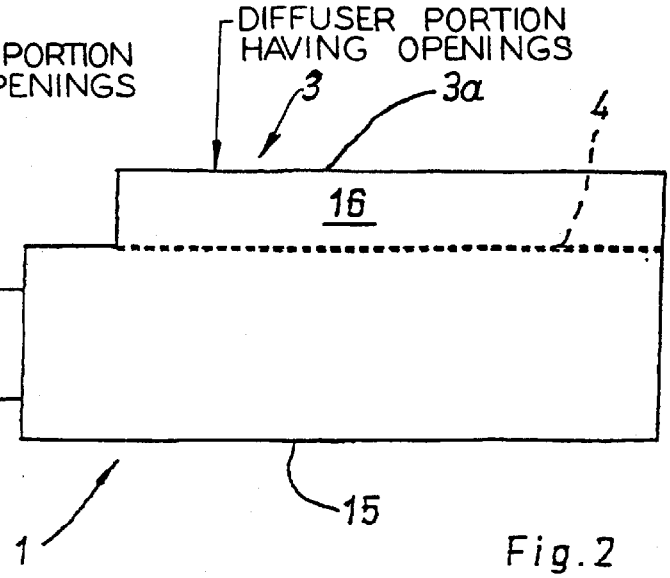
Fig.2
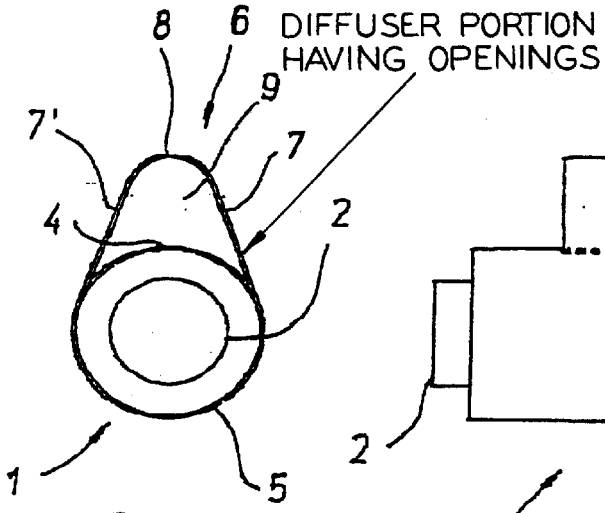
Fig.3
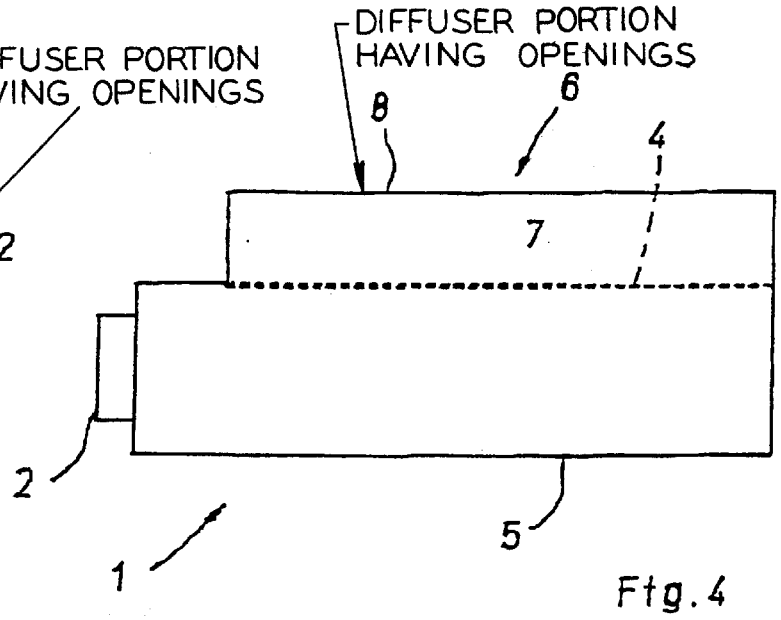
Ftg.4

TUBULAR BURNER

BACKGROUND OF THE INVENTION

The invention concerns a tubular burner provided with a Venturi tube arranged at the inside of the body of the burner, a mixture of air and fuel being fed to the burner through the Venturi tube. The mixture is discharged from the body of the burner through openings made on a diffuser portion of the body and is then caused to burn.

Tubular burners are known having a tubular body, with circular or elliptic cross section, and a Venturi tube coaxial with the burner body. A limited volume is defined at the inside of the burner body between the inner surface of the burner body and the outer surface of the Venturi tube. The flow of the air and fuel mixture, which is discharged from the Venturi tube, must reverse its own direction of flow in order to enter said limited volume and reach said openings. Said reversal of flow direction causes high losses of energy and considerable variations of the values of the characterising parameters of the mixture discharged from said openings, such as pressure, speed, air/fuel rate, over said diffuser portion Said variations leads to incorrect combustion of the mixture of air and fuel, which is not acceptable and can be remedied with great difficulty. Said incorrect combustion may cause, for instance, flame detachment or an increase of the harmful emission of the burner.

Someone has tried to eliminate said drawbacks by arranging the Venturi tube in such a position that the axis of the Venturi tube is separate from the axis of the burner body, particularly by shifting the Venturi tube downward with respect to the diffuser portion of the burner body However, said solution has proved to be unsatisfactory because of an increase of losses of energy at the inside of the burner body caused by the asymmetric position of the Venturi tube.

A further drawback in the known tubular burners, caused by variations of the values of the characterising parameters of the air-fuel mixture discharged from said openings, is a local overheating of the surface of the burner body. Said local overheating is caused by the fumes produced by the combustion that lick the surface of the burner body near said diffuser portion and transmit heat to the burner body by convection.

SUMMARY OF THE INVENTION

The present invention intends to overcome the drawbacks mentioned above.

According to the present invention, there is provided a tubular burner having a body on the surface of which openings are made for discharging a mixture of air and fuel fed to said body through a Venturi tube arranged at the inside of said body, characterized in that said body has a cross section shaped in such a way that the distance between the outer wall of the Venturi tube and the inner wall of said body, when measured in a radial direction of said Venturi tube, has a first value substantially constant in a first portion of the perimeter of the Venturi tube and a second value greater than said first value in a second portion of said perimeter.

That makes possible to make available for the flow of said mixture discharged from the Venturi tube a volume wide enough to allow said flow to reverse the direction of its motion between the outlet of the Venturi tube and the openings made in the burner body without causing variations of the values of the characterising parameters of said mixture across said diffuser portion, when the mixture is discharged from said openings.

BRIEF DESCRIPTION OF THE DRAWINGS

The invention will now be described, by way of non-limiting example, with reference to the enclosed drawings, in which:

FIG. 1 is a cross section of a first embodiment of a burner according to the invention;

FIG. 2 is a side view of the burner of FIG. 1;

FIG. 3 is a cross section of a second embodiment of a burner according to the invention;

FIG. 4 is a side view of the burner of FIG. 3;

DETAILED DESCRIPTION OF THE PREFERRED EMBODIMENTS

Figure 5:
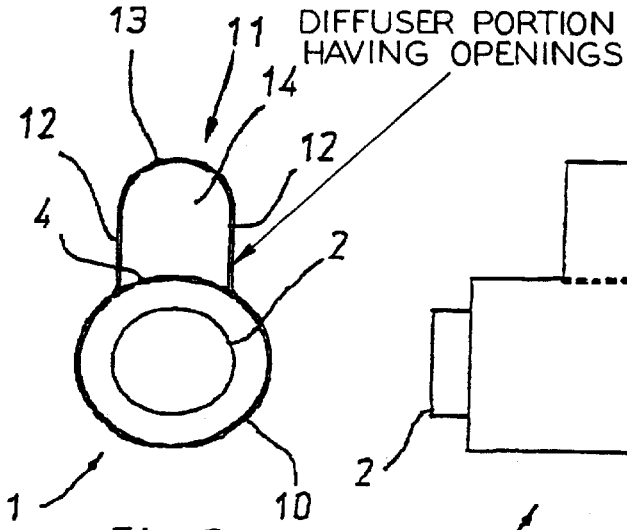
FIG. 5 is a cross section of a third embodiment of a burner according to the invention.

With reference to FIG. 1, the reference numeral 1 indicates the body of a burner according to the invention, inside which a Venturi tube is arranged. A mixture of air and fuel is fed into the burner body 1 through the Venturi tube and is then discharged through openings distributed, for instance, over an upper diffuser portion 3 of the burner body. The burner body 1 has a cross section shaped as a triangle, for instance an isosceles triangle, having a base 15, sides 16, an upper vertex 3*a* and lower vertices 18, all the vertices 3*a* and 18 being rounded. The Venturi tube 2 is arranged at the inside of the burner body 1 in such a way that the distance between the outer surface of the Venturi tube 2 and the inner surface of the burner body 1 is substantially constant across a significant portion of the perimeter of the Venturi tube 2 and increases progressively across the remaining portion of the perimeter until it reaches a maximum value in the region of the diffuser portion 3 of the burner body 1. A chamber 19 is defined between upper portion of the Venturi tube 2 and said diffuser portion 3 of the burner body 1, the mixture discharged from the Venturi tube 2 passing through said chamber 19.

The presence of the chamber 19 makes possible to decrease the losses of energy suffered by the mixture discharged from the Venturi tube 2, when the mixture reverses the direction of its own motion. In addition, when the mixture passes through said chamber 19, before being discharged through the openings made in the burner body 1, the characterizing parameters of the mixture tends to become uniform and the speed vector of the mixture tends to become substantially perpendicular to the burner body 1. The uniformity of the characterizing parameters of the mixture may be further improved by providing laminar flow generating means 4 between the Venturi tube 2 and the diffuser portion 3 of the burner body 1. When said mixture passes through said laminar flow generating means 4, a substantially laminar flow of the mixture is generated. Said laminar flow generating means 4 may consist, for instance, of a mesh element 4, shaped as a sector of a cylindrical surface, In addition, the laminar flow generating means 4 may consists of a perforated plate element, or a honeycomb shaped element, or baffle means, etc.

FIGS. 3 and 4 show a second embodiment of the present invention in which the cross section of the burner body 1 comprises a lower portion 5 having a substantially circular shape and an upper portion 6 consisting of a pair of sides converging upwards and connected by a curvilinear stretch 8. Said curvilinear stretch 8 constitutes the diffuser portion of the burner body 1 over which the openings discharging said mixture of air and fuel are distributed. The lower portion 5 of said cross section extends over an angle of more than 180°. The distance between the outer wall of the Venturi tube 2 and the inner wall of the burner body 1 in said lower portion 5 is substantially constant, whilst said distance increases progressively in said upper portion 6 up to a maximum value in the central part of said curvilinear portion 8.

At inside of said upper portion 6 a chamber 9 is defined having the same purpose as the chamber 19 previously described.

Laminar flow generating means 4 may be interposed between the Venturi tube 2 and the chamber 9.

Figure 6:
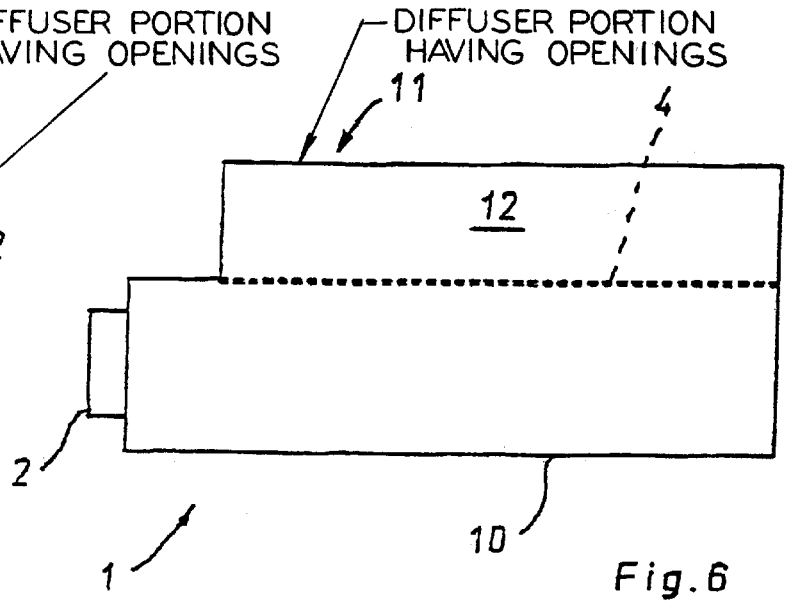
FIG. 6 is a side view of the burner of FIG. 5.

FIGS. 5 and 6 show a third embodiment of a burner according to the invention, in which the cross section of the burner body 1 comprises a lower portion 10 having a substantially circular shape and an upper portion 11 consisting of a pair of substantially vertical sides 12, the upper ends of which are connected by a curvilinear stretch 13. Said curvilinear stretch 13 constitutes the diffuser portion of the burner body 1 over which the openings for discharging the mixture of air and fuel are distributed. The lower portion 10 of said cross section extends over an angle of more than 180°. The distance between the outer wall of the Venturi tube 2 and the inner wall of the burner body 1 in said lower portion 10 is substantially constant, whilst said distance increases suddenly in said upper portion 11 up to a maximum value in the central part of said curvilinear portion 13.

At inside of said upper portion 11 a chamber 14 is defined having the same purpose as the chambers 9 and 19 previously described.

Laminar flow generating means 4 may be interposed between the Venturi tube 2 and the chamber 14.

Figure 7:
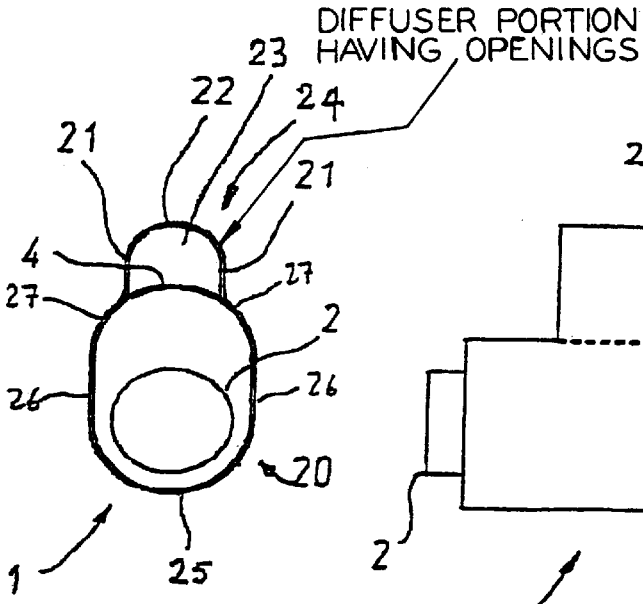
FIG. 7 is a cross section of a fourth embodiment of a burner according to the invention.
Figure 8:
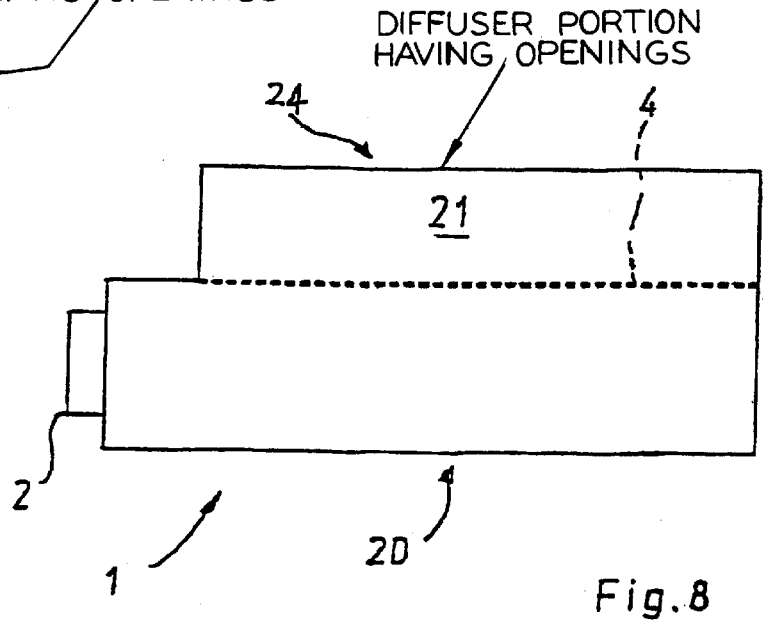
FIG. 8 is a side view of the burner of FIG. 7.

FIGS. 7 and 8 show a fourth embodiment of a burner according to the invention, in which the cross section of the burner body 1 comprises a lower portion 20 comprising a pair of substantially rectilinear sides 26 the lower ends of which are connected by a curvilinear stretch 25, and an upper portion 24 consisting of a pair of substantially vertical sides 21, the upper ends of which are connected by a further curvilinear stretch 22. Said further curvilinear stretch constitutes the diffuser portion of the burner body over which the openings for discharging the mixture of air and fuel are arranged. The lower ends of the substantially vertical sides 21 are connected to corresponding ends of the rectilinear sides 26 by means of still further curvilinear stretches 27. The Venturi tube 2 may be arranged at the inside of said lower portion 20 in a symmetric or asymmetric position. In a still farther embodiment of a burner according to the invention, not shown, the lower portion 20 of the burner body may have an elliptic shape.

At inside of said upper portion 24 a chamber 23 is defined having the same purpose as the chambers 9, 14 and 19 previously described.

In all the embodiments shown, the slope of the sides of burner body 1, in the regions near the diffuser portion 3, 8, 13, 22 of the burner body, makes possible to prevent the fumes produced by the combustion from licking the surface of the burner body in said regions, thus causing overheating.

What is claimed is:

1. A tubular burner having a body comprising:

a diffuser portion provided with openings for discharging a mixture of air and fuel fed to said body through a Venturi tube arranged inside said body, said body having a cross section shaped in such a way that a distance between an outer wall of the Venturi tube and an inner wall of said body, when measured in a radial direction of the Venturi tube, has a first value substantially constant over a first portion of a perimeter of the Venturi tube and a second value greater than said first value over a second portion of said perimeter, a chamber being defined in said second portion between the outer wall of the Venturi tube and the inner wall of said body, said mixture passing through said chamber before being discharged through said openings;

wherein said chamber is delimited at a bottom thereof by laminar flow generating means for generating a substantially laminar flow of said mixture; and wherein said second value increases from ends of said second portion towards a center of said second portion.

2. A tubular burner having a body comprising:

a diffuser portion provided with openings for discharging a mixture of air and fuel fed to said body through a Venturi tube arranged inside said body, said body having a cross section shaped in such a way that a distance between an outer wall of the Venturi tube and an inner wall of said body, when measured in a radial direction of the Venturi tube, has a first value substantially constant over a first portion of a perimeter of the Venturi tube and a second value greater than said first value over a second portion of said perimeter, a chamber being defined in said second portion between the outer wall of the Venturi tube and the inner wall of said body, said mixture passing through said chamber before being discharged through said openings;

wherein said chamber is delimited at a bottom thereof by laminar flow generating means for generating a substantially laminar flow of said mixture, said laminar flow generating means comprising mesh means.

3. The tubular burner according to claim 2, wherein said mesh means has a curvilinear shape.

4. The tubular burner according to claim 2, wherein said first portion extends over an angle of more than 180°.

5. The tubular burner according to claim 2, wherein said cross section comprises a lower portion having a substantially circular shape and an upper portion comprising a pair of substantially vertical sides, upper ends of said sides being connected by a curvilinear stretch.

6. The tubular burner according to claim 5 wherein said lower part extends over an angle of more than 180°.

7. The tubular burner according to claim 2, wherein said cross section comprises a lower portion substantially elliptic and an upper portion comprising a pair of substantially vertical sides having upper ends connected by a curvilinear stretch.

8. The tubular burner according to claim 2, wherein said cross section comprises a lower portion provided with a pair of substantially rectilinear sides having lower ends connected by a curvilinear stretch and an upper portion comprising a pair of substantially vertical sides having upper ends connected by a further curvilinear stretch.

9. The tubular burner according to claim 8, wherein the lower ends of said substantially vertical sides are connected to corresponding ends of said rectilinear sides by means of still further curvilinear stretches.

10. A tubular burner having a body comprising:

a diffuser portion provided with openings for discharging a mixture of air and fuel fed to said body through a Venturi tube arranged inside said body, said body having a cross section shaped in such a way that a distance between an outer wall of the Venturi tube and an inner wall of said body, when measured in a radial direction of the Venturi tube, has a first value substantially constant over a first portion of a perimeter of the Venturi tube and a second value greater than said first value over a second portion of said perimeter, a chamber being defined in said second portion between the outer wall of the Venturi tube and the inner wall of said body, said mixture passing through said chamber before being discharged through said openings;

wherein said chamber is delimited at a bottom thereof by laminar flow generating means for generating a substantially laminar flow of said mixture; and wherein said cross section is shaped as a triangle with rounded vertices.

11. The tubular burner according to claim 10, wherein said triangle is an isosceles triangle.

12. A tubular burner having a body comprising:

a diffuser portion provided with openings for discharging a mixture of air and fuel fed to said body through a Venturi tube arranged inside said body, said body having a cross section shaped in such a way that a distance between an outer wall of the Venturi tube and an inner wall of said body, when measured in a radial direction of the Venturi tube, has a first value substantially constant over a first portion of a perimeter of the Venturi tube and a second value greater than said first value over a second portion of said perimeter, a chamber being defined in said second portion between the outer wall of the Venturi tube and the inner wall of said body, said mixture passing through said chamber before being discharged through said openings;

wherein said chamber is delimited at a bottom thereof by laminar flow generating means for generating a substantially laminar flow of said mixture; and wherein said cross section comprises a lower portion having a substantially circular shape and an upper portion comprising a pair of sides converging upwards, upper ends of said sides being connected by a curvilinear stretch.

13. The tubular burner according to claim 12 wherein said lower part extends over an angle of more than 180°.

* * * * *